US006842912B1

(12) United States Patent
King et al.

(10) Patent No.: US 6,842,912 B1
(45) Date of Patent: Jan. 18, 2005

(54) EXPANDABLE TROUSER BELT

(75) Inventors: Mary Rice King, Lemont, IL (US); Wava Junior, Berkley, IL (US); Jose Rodriguez, Chicago, IL (US)

(73) Assignee: Humphreys Accessories, LLC, Chicago, IL (US)

( * ) Notice: Subject to any disclaimer, the term of this patent is extended or adjusted under 35 U.S.C. 154(b) by 0 days.

(21) Appl. No.: 10/688,408

(22) Filed: Oct. 17, 2003

(51) Int. Cl.[7] ..... A41F 9/00
(52) U.S. Cl. ..... 2/338; 2/311; 128/101.1
(58) Field of Search ..... 2/338, 300, 310–323, 2/80, 83, 76, 221, 229, 94, 237, 920, 44–45, 339; 128/95.1, 99.1, 100.1, 869, 101.1

(56) References Cited

U.S. PATENT DOCUMENTS

| | | | | | |
|---|---|---|---|---|---|
| 1,463,904 | A | | 8/1923 | Mix | |
| 1,618,389 | A | | 2/1927 | Sampson et al. | |
| 1,619,138 | A | | 3/1927 | Kollstede | |
| 1,622,954 | A | | 3/1927 | Macheroux | |
| 2,087,151 | A | | 7/1937 | Hornberger | |
| 2,147,619 | A | | 2/1939 | Wirth | |
| 2,185,834 | A | * | 1/1940 | Creper | 450/134 |
| 2,388,752 | A | | 11/1945 | Loos, Jr. | |
| 4,095,415 | A | * | 6/1978 | Bower | 59/35.1 |
| 5,054,433 | A | * | 10/1991 | Pfleger | 119/856 |
| 5,823,409 | A | * | 10/1998 | Kennedy | 224/175 |
| 6,108,821 | A | | 8/2000 | Malsoute | |
| 6,393,671 | B1 | | 5/2002 | Chen | |
| 6,449,775 | B1 | * | 9/2002 | Battaglia | 2/312 |
| 6,681,406 | B2 | * | 1/2004 | Yang | 2/338 |

* cited by examiner

*Primary Examiner*—Tejash Patel
(74) *Attorney, Agent, or Firm*—Caesar, Rivise, Bernstein, Cohen & Pokotilow, Ltd.

(57) ABSTRACT

A trouser belt is provided having a strap, a buckle and a keeper. The strap has a first and a second end and includes two substantially nonelastic portions and a short elastic portion. The short elastic portion is located between the two nonelastic portions and provides a limited amount of lengthwise expansion to the strap. The buckle is attached to the first end of the strap to secure a portion of the strap adjacent to the second end of the strap. The keeper is mounted adjacent to the buckle to hold the second of the belt to the first end of the belt. Preferably, the keeper is secured to the strap adjacent to the buckle and the short elastic portion is located substantially beneath the keeper.

6 Claims, 2 Drawing Sheets

EXPANDABLE TROUSER BELT

BACKGROUND OF THE INVENTION

The present invention relates to a belt for trousers. More particularly, the present invention relates to a belt for trousers that is more comfortable for one who wears the belt by providing for a limited amount of elastic expansion.

The present invention relates to a belt for trousers that provides for a limited amount of elastic expansion to accommodate the comfort of one who wears the belt. A resilient belt is obtained whereby the circumference of the circular area defined by the belt while being worn may be changed in accordance with the requirements of the body of the user of the belt. For example, the circumference of the belt may be required to change during periods of exertion, after eating a large meal, or under any other conditions where a slight increase, for example, a one-half inch to a one inch increase, in the length of the belt, without repositioning the buckle, is desirable. It is also desirable that a user of the belt is not inconvenienced and/or embarrassed by the need to adjust his or her belt by unbuckling and re-buckling the belt to allow for more slack during such activity.

When such a belt is used in association with a body, it is also highly desirable that the resilient portion be relatively inconspicuous such that only the person who wears the belt is aware of the resilient feature.

Numerous patents have addressed these needs. However, these patents are universally substantially more complicated than the simple and elegant design of the present invention. Additionally, typically, these patents are directed to an expansion feature in the buckle of the belt rather than the strap portion of the belt. For example, U.S. Pat. No. 2,147,619 (Wirth) is directed to a belt buckle having an expansion feature where the strap of the belt is connected to a yoke attached to the buckle where the yoke has a spring that biases the strap towards the buckle.

U.S. Pat. No. 6,108,821 (Malsoute) is directed to a trouser belt having an extensible clasp. Here, the user of the belt presses tappets that protrude from the belt buckle that free a sliding plate when pressed to disengage a ratchet. The user can loosen his belt, for example, after eating a large meal, by pressing the tappets to increase the circumference of the buckled belt.

U.S. Pat. No. 2,087,151 (Homberger) is directed to a yieldable belt connection. An elongated plate provides a pair of spaced apart sleeves through which the main axis point of the buckle passes. The plate is mounted on the axis point so that the buckle can move relative to the plate. Springs urge the buckle toward the strap.

U.S. Pat. No. 6,393,671 (Chen) discloses an elastic belt buckle that has a prong which slides on the base of the buckle by means of an elastic device. The belt is buckled by fastening the prong into a punched hole in the belt.

Other similar patents, each of which includes a mechanical expansion feature as part of its buckle, include U.S. Pat. No. 2,388,752 (Loos), U.S. Pat. No. 1,619,138 (Kollstede), U.S. Pat. No. 1,622,954 (Macheroux), U.S. Pat. No. 1,618,389 (Sampson et al.) and U.S. Pat. No. 1,463,904 (Mix).

All references cited herein are incorporated herein by reference in their entireties.

BRIEF SUMMARY OF THE INVENTION

A trouser belt is provided which includes a strap having a first and a second end. The strap has two substantially nonelastic portions and a short elastic portion. The short elastic portion is located between the two nonelastic portions and provides a limited amount of lengthwise expansion to the strap. A buckle is attached to the first end of the strap to secure a portion of the strap adjacent to the second end of the strap. A keeper on the strap is located adjacent to the buckle to hold the second of the belt to the first end of the belt.

Preferably, the short elastic portion is located substantially beneath the keeper and, more preferably, hidden by the keeper. Additionally, in the most preferable embodiment, the short elastic portion includes a first elastic strip and a second elastic strip where the first elastic strip lies generally face to face with the second elastic strip. Here, the keeper is secured between the first elastic strip and the second elastic strip.

BRIEF DESCRIPTION OF SEVERAL VIEWS OF THE DRAWINGS

The invention will be described in conjunction with the following drawings in which like reference numerals designate like elements and wherein.

DETAILED DESCRIPTION OF THE INVENTION

Figure 1:
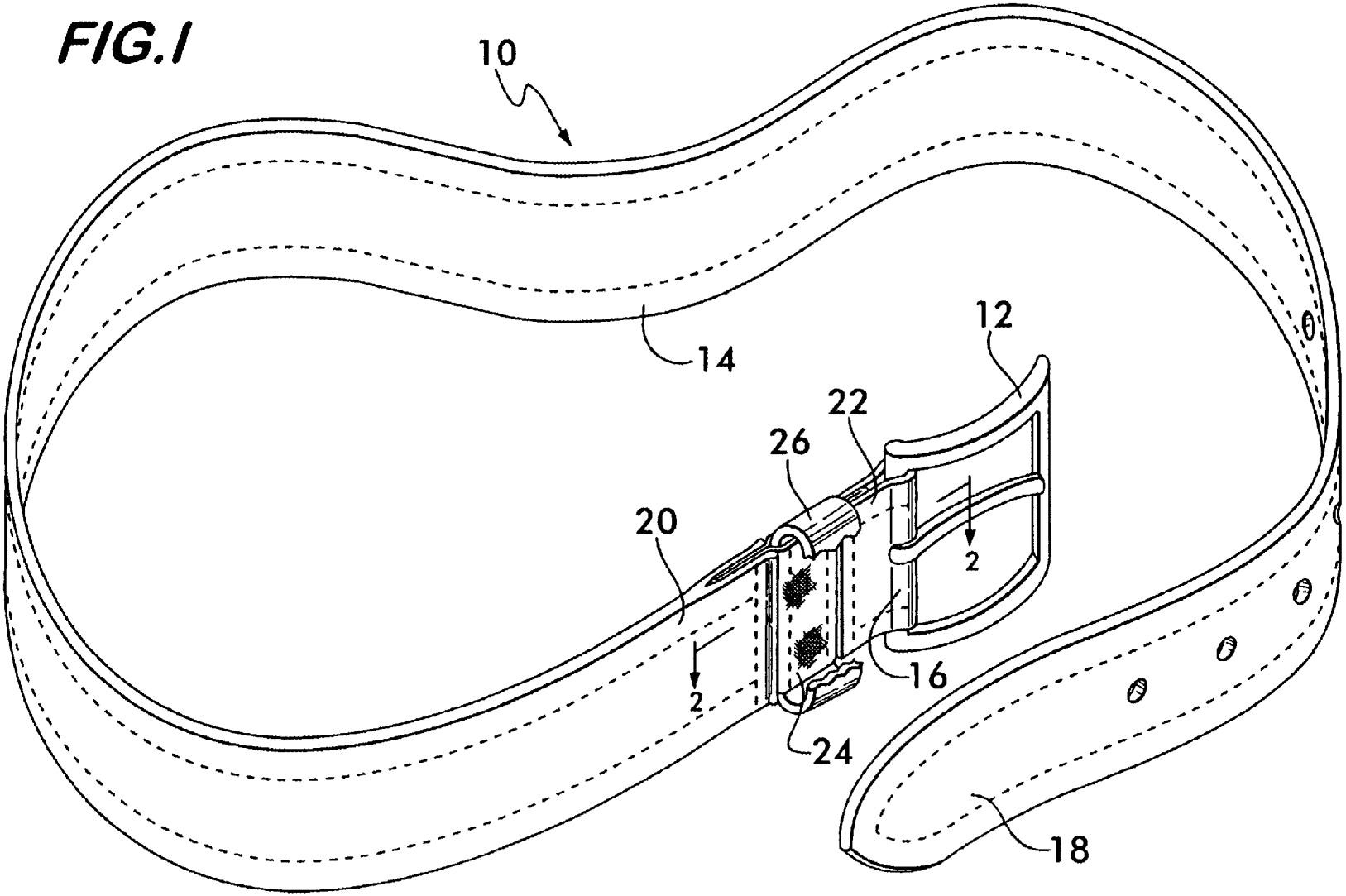
FIG. 1 is an isometric view of an expandable belt in accordance with one preferred embodiment of the present invention.

Referring now to the drawings, wherein like elements refer to like part numbers throughout the several views, there is shown in FIG. 1, an expandable trouser belt 10 in accordance with one preferred embodiment of the present invention. The expandable trouser belt 10 includes a buckle 12 and a strap 14 having a first end 16 and a second end 18. The strap includes two substantially nonelastic portions 20, 22 and a short elastic portion 24. The short elastic portion 24 is located between the two nonelastic portions 20, 22 and provides a limited amount of lengthwise stretchable expansion to the strap 14. The buckle 12 is attached to the first end 16 of the strap 14 to secure a portion of the strap 14 adjacent to the second end 18 of the strap 14. A keeper 26 is located on the strap 14 adjacent to the buckle 12 to hold the second end 18 of the strap 14 to the first end 16 of the strap 14.

Figure 2:
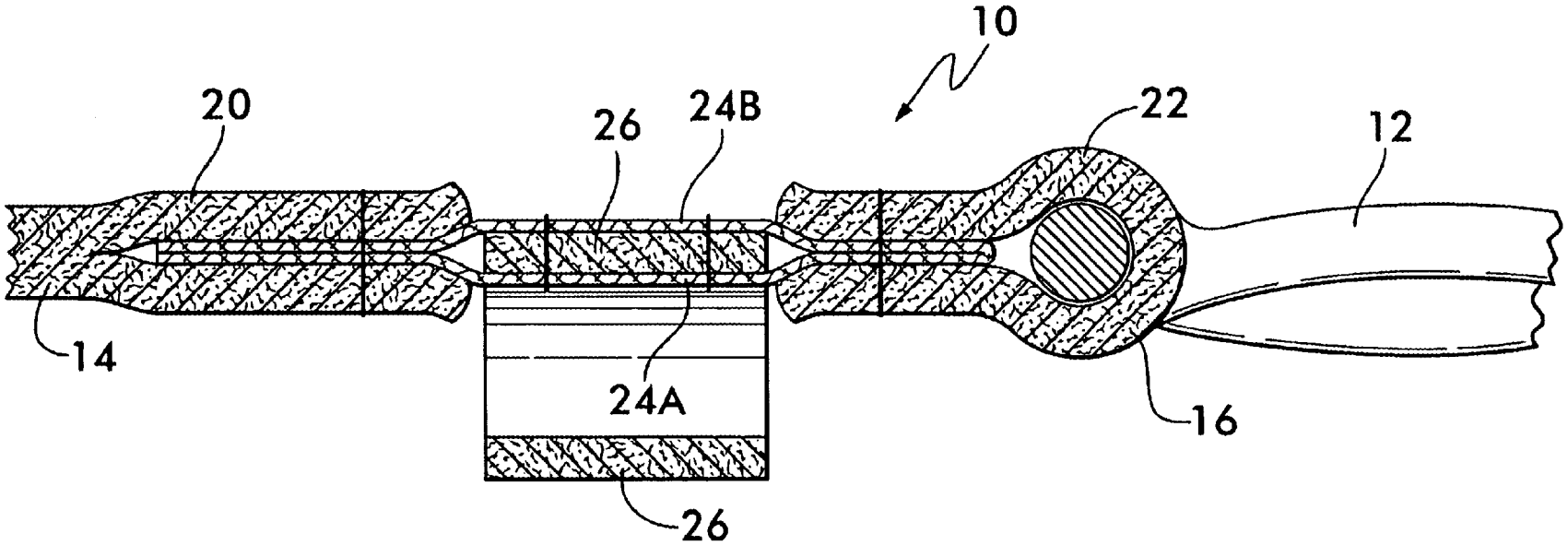
FIG. 2 is a partial, cross-sectional view of the expandable belt of FIG. 1, taken substantially along lines 2—2 of FIG. 1.

As shown in FIGS. 1 and 2, preferably, the keeper 26 is secured to the strap 14 adjacent to the buckle 12 and the short elastic portion 24 (which includes 24A and 24B) is located substantially beneath the keeper 12. Here, the keeper 12 may cover the entire short elastic portion 24, thereby entirely hiding the short elastic portion 24 from view (when viewing the belt from its top side), or may cover only a portion of it.

As seen most clearly in FIG. 2, in a particularly preferred embodiment of the belt 10 of the present invention, the short elastic portion 24 includes a first elastic strip 24A and a second elastic strip 24B where the first elastic strip 24A lies generally face to face to the second elastic strip 24B. Here, the keeper 12 is secured between the first elastic strip 24A and the second elastic strip 24B such that it is captured in place adjacent to the buckle 12.

By configuring the belt 10 in this manner, an extra step of securing the keeper 12 to the strap 14 during the manufacture of the belt 10 is eliminated. The nonelastic portions 20, 22 of the strap 14 of present invention may be substantially any type of appropriate nonelastic strap material including, for example, leather, vinyl, fabric, and the like. The nonelastic portions 20, 22 need not be constructed of identical materials. Any type of trouser belt buckle 12, as known, may be used.

While the invention has been described in detail and with reference to specific embodiments thereof, it will be apparent to one skilled in the art that various changes and modifications can be made therein without departing from the spirit and scope thereof.

What is claimed is:

1. A trouser belt, comprising:

(a) a strap having a first and a second end, the strap comprising two substantially nonelastic portions and a short elastic portion, the short elastic portion located between the two nonelastic portions, the short elastic portion providing a limited amount of lengthwise expansion to the strap;

(b) a buckle attached to the first end of the strap to secure a portion of the strap adjacent to the second end of the strap; and (c) a keeper on the strap adjacent to the buckle to hold the second of the belt to the first end of the belt, the keeper secured to the strap adjacent to the buckle, the short elastic portion located substantially beneath the keeper.

2. The trouser belt of claim 1, wherein the short elastic portion is generally hidden by the keeper.

3. A trouser belt, comprising:

(a) a strap having a first and a second end, the strap comprising two substantially nonelastic portions and a short elastic portion, the short elastic portion located between the two nonelastic portions, the short elastic portion providing a limited amount of lengthwise expansion to the strap;

(b) a buckle attached to the first end of the strap to secure a portion of the strap adjacent to the second end of the strap;

(c) a keeper on the strap adjacent to the buckle to hold the second of the belt to the first end of the belt; and (d) the short elastic portion comprising a first elastic strip and a second elastic strip, the first elastic strip lying face to face to the second elastic strip and wherein the keeper is secured between the first elastic strip and the second elastic strip.

4. A trouser belt, comprising:

(a) a strap having a first and a second end, two substantially nonelastic portions and short elastic portion, the short elastic portion located between the two nonelastic portions, the short elastic portion providing a limited amount of lengthwise expansion to the strap;

(b) a buckle attached to the first end of the strap to secure a portion of the strap adjacent to the second end of the strap; and (c) a keeper secured to the strap adjacent to the buckle to hold the second of the belt to the first end of the belt, the short elastic portion being substantially beneath the keeper.

5. The trouser belt of claim 4 wherein the short elastic portion is generally hidden by the keeper.

6. A trouser belt, comprising:

(a) a strap having a first and a second end, two substantially nonelastic portions and short elastic portion, the short elastic portion located between the two nonelastic portions, the short elastic portion providing a limited amount of lengthwise expansion to the strap;

(b) a buckle attached to the first end of the strap to secure a portion of the strap adjacent to the second end of the strap;

(c) a keeper secured to the strap adjacent to the buckle to hold the second of the belt to the first end of the belt, the short elastic portion being substantially beneath the keeper; and (d) the short elastic portion comprising a first elastic strip and a second elastic strip, the first elastic strip lying face to face to the second elastic strip and wherein the keeper is secured between the first elastic strip and the second elastic strip.

* * * * *